US009289873B2

(12) United States Patent
Scholz

(10) Patent No.: US 9,289,873 B2
(45) Date of Patent: Mar. 22, 2016

(54) ABRASIVE CUTTING MACHINE

(71) Applicant: MAKITA CORPORATION, Aichi (JP)

(72) Inventor: Klaus Scholz, Hamburg (DE)

(73) Assignee: MAKITA CORPORATION, Aichi (JP)

( * ) Notice: Subject to any disclaimer, the term of this patent is extended or adjusted under 35 U.S.C. 154(b) by 316 days.

(21) Appl. No.: 13/895,806

(22) Filed: May 16, 2013

(65) Prior Publication Data

US 2014/0024298 A1 Jan. 23, 2014

(30) Foreign Application Priority Data

Jul. 17, 2012 (DE) ..... 20 2012 102 642 U

(51) Int. Cl.
*B24B 27/06* (2006.01)
*B24B 27/08* (2006.01)

(52) U.S. Cl.
CPC ..... *B24B 27/065* (2013.01); *B24B 27/08* (2013.01)

(58) Field of Classification Search
CPC ..... B24B 27/065; B24B 27/08; B25F 5/008; B27C 1/14
See application file for complete search history.

(56) References Cited

U.S. PATENT DOCUMENTS

2003/0129934 A1* 7/2003 Huber ..... 451/357
2008/0104936 A1* 5/2008 Kellermann ..... 55/357
2011/0148227 A1* 6/2011 Schuele et al. ..... 310/50
2012/0302147 A1* 11/2012 Trautner et al. ..... 451/488
2014/0287857 A1* 9/2014 Doering ..... 474/93
2015/0027743 A1* 1/2015 Kumagai ..... 173/46
2015/0054361 A1* 2/2015 Hess et al. ..... 310/50

FOREIGN PATENT DOCUMENTS

DE 1794092 8/1959
DE 19541526 5/1996
DE 102005060669 A1 * 6/2007

OTHER PUBLICATIONS

DE 102005060669—English Machine Translation, Jun. 2007 Papp et al.*
German Search Report and English translation thereof, dated Apr. 17, 2013.

* cited by examiner

*Primary Examiner* — Joseph J Hail
*Assistant Examiner* — Marc Carlson
(74) *Attorney, Agent, or Firm* — Greenblum & Bernstein, P.L.C.

(57) ABSTRACT

An abrasive cutting machine includes a housing and a cutting arm on which a cutting tool is accommodated on the end side. The cutting tool is driven via a belt by an engine of the abrasive cutting machine, and the housing encompasses a fan chamber for accommodating a fan wheel by which an air flow is provided. A belt chamber for accommodating the belt is embodied in the cutting arm, with improved durability of a belt, in particular the dust exposure of the belt for power transfer from the engine to the cutting tool. Provision is made between the fan chamber and the belt chamber for an air duct, through which at least a part of the air flow, which is created by the fan wheel, reaches from the fan chamber into the belt chamber, so as to apply a sealing air flow to the belt chamber.

11 Claims, 2 Drawing Sheets

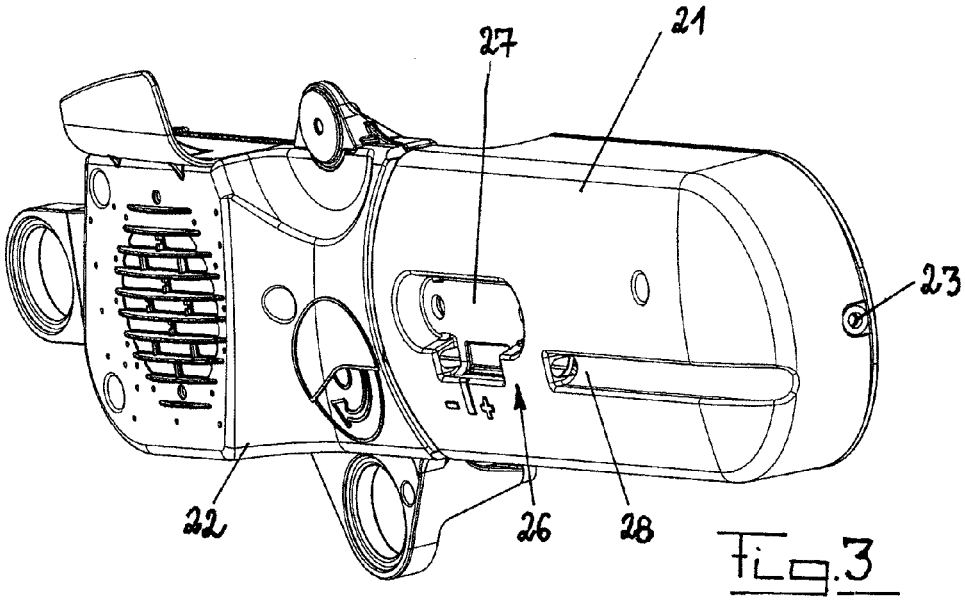
Fig.3
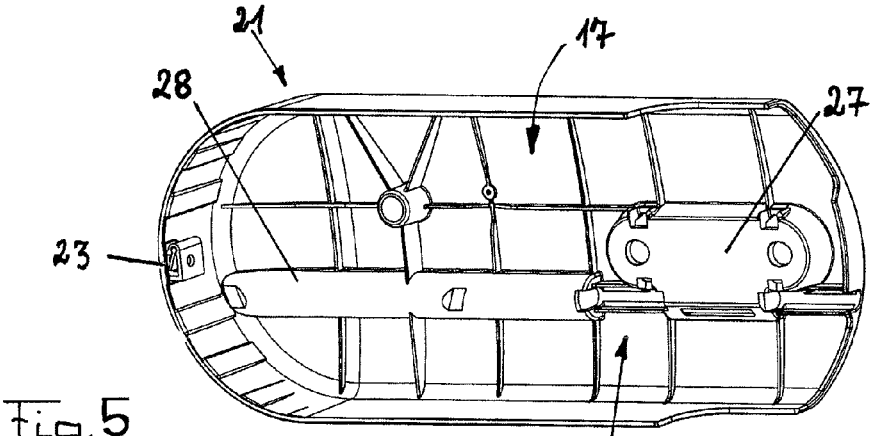
Fig.5
Fig.4
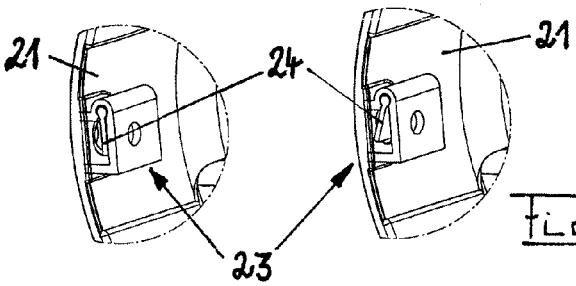
Fig.6

ABRASIVE CUTTING MACHINE

The instant invention relates to an abrasive cutting machine comprising a housing and comprising a cutting arm, on which a cutting tool is accommodated on the end side, wherein the cutting tool is driven via a belt by means of an engine of the abrasive cutting machine, and wherein the housing encompasses a fan chamber for accommodating a fan wheel, by means of which an air flow is provided, and wherein a belt chamber for accommodating the belt is embodied in the cutting arm.

PRIOR ART

Working with an abrasive cutting machine often leads to a high dust exposure, for example when stone materials are cut by means of the abrasive cutting machine. The dust and dirt-sensitive components of the abrasive cutting machine are thus kept as dust-tight as possible, but there is the disadvantage that the dust-sensitive components are subjected to a certain dust exposure through cracks and gaps after prolonged use of an abrasive cutting machine in spite of encasing the dust-sensitive components. The abrasive cutting machines can be embodied with an engine according to the type of an internal combustion engine, and the internal combustion engine must be supplied with clean combustion air, for the purpose of which cyclone filters and/or filters, such as paper filters or textile filters, are used on principle. For this purpose, an air flow is created, which serves mainly to cool the cylinder of the internal combustion, by means of a fan wheel, which is preferably also driven by the engine of the abrasive cutting machine.

The housing of the abrasive cutting machine can form a part of the crankcase of the abrasive cutting machine, for example, or the housing forms a base body or a frame of the abrasive cutting machine. A fan chamber, in which a fan wheel is accommodated, is embodied in the housing, and the fan chamber and the fan wheel can be arranged on a first side of the housing, for example, and the cutting arm for accommodating the cutting tool on the end side can be arranged on an opposite, second side of the housing. It is thereby furthermore known that a respective end of the crankshaft of the internal combustion engine can extend out of both housing sides, and the fan wheel can be accommodated on a first side and a pulley for driving the cutting tool via a belt can be accommodated on a second side. Dispersed dust of the abrasive cutting machine can reach into the belt chamber due to the air vortex, which is created by the rotating cutting tool, and it is known that the durability of a belt as well as the transferability of larger powers by the belt is impacted negatively in response to an increasing dust exposure of the belt.

DESCRIPTION OF THE INVENTION: OBJECT, SOLUTION, ADVANTAGES

It is thus the object of the instant invention to create an abrasive cutting machine comprising an improved durability of a belt. In particular, it is the object of the invention to further improve the dust exposure of the belt for the power transfer from the engine to the cutting tool.

This object is solved based on an abrasive cutting machine according to the preamble of claim 1 in combination with the characterizing features. Advantageous further developments of the invention are specified in the dependent claims.

The invention includes the technical teaching that provision is made between the fan chamber and the belt chamber for an air duct, through which at least a part of the air flow, which is created by the fan wheel, reaches from the fan chamber into the belt chamber, so as to apply a sealing air flow to the belt chamber.

The belt chamber can be embodied so as to be substantially closed, and, according to the invention, an overpressure is formed in the belt chamber by means of the sealing air flow.

The invention is based on the idea of preventing a permeation of dust and impurities of any type, e.g. through cracks and gaps, into the belt chamber by means of a sealing air flow. As long as an overpressure prevails in the belt chamber, the sealing air prevents the permeation of dust and other impurities into the belt chamber, because the sealing air escapes through the openings, cracks and gaps from the inside to the outside, and thus blocks the path for impurities from the outside into the belt chamber.

According to an advantageous, further improved embodiment of the instant invention, provision can be made for a cyclone filter, which serves to clean the sealing air, which reaches from the fan chamber into the belt chamber. The air of the air flow, which is created by the fan wheel, can also be air, which is exposed to impurities and dust, and to prevent the introduction of the dust and of the impurities into the belt chamber through the air duct, provision can be made for a cyclone filter, which cleans the air flow, which enters into the belt chamber. The sealing air flow, which enters into the belt chamber, can consequently be formed through the clean side of the cyclone filter.

The cyclone filter can be arranged so as to adjoin the air duct, for example on the side of the housing. According to a preferred embodiment, the cyclone filter itself, however, can already form a part of the air duct between the fan chamber and the belt chamber. The air duct can thus be formed, for example, by means of an opening in the housing and a further opening in the cutting arm, which is provided at a distance from this opening, and the two openings can encompass center axes, which are aligned with one another. The cyclone filter, which thus forms a partial duct of the air duct between the fan chamber and the belt chamber, can be integrated into the area, via which the two openings are spaced apart from one another. The air, which is exposed to dust and impurities, which enters into the cyclone filter from the fan chamber, can reach the outside, for example, through an outlet opening of the cyclone filter. To even further improve the air purity of the sealing air flow, provision can be made downstream from the cyclone filter and in particular on the end side of the air duct for a further filter element, for example a paper filter or a textile filter. Exceptionally cleaned air can thus be applied to the belt chamber. For example, the cyclone filter can also be formed by means of the crankcase, can be cast thereto or can already be cast into it in a casting process.

The air flow provided by the fan wheel can partially and preferably mainly form a cooling air for the engine of the abrasive cutting machine. According to a further embodiment, the fan wheel, however, can also serve only to provide the sealing air flow. For example, the fan wheel can encompass a rear blading, by means of which a separate air flow can be provided, which is guided into the belt chamber through the air duct and in particular through the cyclone filter.

According to a further exemplary embodiment, the abrasive cutting machine can encompass at least one cover element, which forms a limiting part of the belt chamber. For example, the cover element can be arranged laterally on the cutting arm and the cutting arm forms a first limiting part of the belt chamber and the cover elements form a further limiting part, which closes the belt chamber. Provision can thereby be made in the cover element, but also in the cutting arm for a venting device, via which the sealing air can escape from the belt chamber. For example, a first cover element can be arranged on the engine-side end of the cutting arm, and a further cover element can be arranged on the tool-side end of the cutting arm. Both cover elements can thereby form parts, which limit the belt chamber. The venting device, through which the sealing air can escape from the belt chamber in a controlled manner, can be provided in at least one of the two cover elements. For this purpose, the venting device can encompass a non-return valve, for example, through which sealing air escapes from the belt chamber, but which prevents the permeation of contaminated air. The non-return valve can be formed by means of a simple resilient lug, a tongue or a flap, for example.

A particular advantage is created when the air duct leads into the belt chamber on the engine-side end and/or the housing-side end of the cutting arm and wherein the venting device is arranged on the tool-side end of the cutting arm. The sealing air flow consequently flows through the belt chamber from the engine side to the tool side, and the venting device comprising the non-return valve can be arranged on the end side on the cutting arm or on the rear, tool-side cover element, for example.

It is also advantageous when the cutting arm is arranged directly on the housing, in particular by means of fastening means. The fastening means can be screw connections, for example, by means of which the cutting arm is arranged laterally on the housing. The air duct can consequently be formed by means of two openings, which are fluidically connected to one another, wherein a first opening is introduced in the housing and a further openings is introduced in the cutting arm.

According to yet a further embodiment, the air flow through the air duct for forming the sealing air can also be provided by means of air, which is available from the suction area of the combustion engine. This air can then already be cleaned and, provided that the air provided from the suction area encompasses an overpressure, this air can serve as sealing air in the belt chamber. To direct the air, provision can be made for flow aids, which can also be arranged on the crankcase or on an attached cover, similar to air guiding ribs, which are known for directing air for a cylinder cooling. In a further advantageous manner, the sealing air, which is guided into the belt chamber through the air duct, can be cold air, so that the work area of the belt is not only kept clean, but is also cooled.

The term of the housing of the abrasive cutting machine refers to every component of the abrasive cutting machine, from which an air flow can be guided into the air duct. The housing can consequently also be the accommodating housing for the carburetor of the combustion engine of the abrasive cutting machine, for example.

BRIEF DESCRIPTION OF THE DRAWINGS

Further measures, which improve the invention, will be illustrated in more detail below by means of the figures together with the description of a preferred exemplary embodiment of the invention:

FIG. 3 shows a perspective illustration of a first and of a second cover element for arrangement on the cutting arm, FIG. 4 shows a perspective illustration of the second cover element FIG. 5 shows a detailed illustration of a venting device in the cover element comprising a non-return valve in a closed state and FIG. 6 shows the detailed illustration of the venting device comprising a non-return valve in an open state.

PREFERRED EMBODIMENTS OF THE INVENTION

Figure 1:
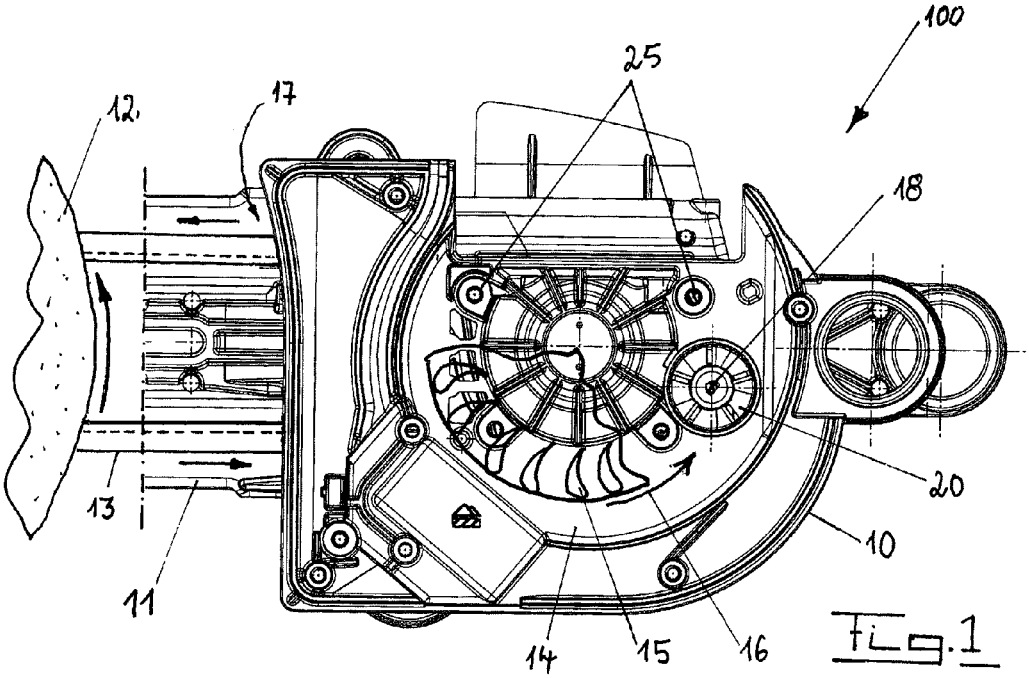
FIG. 1 shows a side view of an abrasive cutting machine comprising a housing, a fan wheel accommodated in the housing, and a cutting arm.

In a perspective illustration, FIG. 1 shows an exemplary embodiment of an abrasive cutting machine 100 in a partially figuratively schematized arrangement. A housing 10 is shown, on which a cutting arm 11 is arranged on the rear side. An engine, which drive a cutting tool 12 via a belt 13 in a rotating manner, is furthermore present on the housing 10 in a manner, which is not shown in detail. The cutting tool 12 is rotatably accommodated on the free end of the cutting arm 11 in a manner, which is also not shown in detail. The cutting arm 11 forms a part of a belt chamber 17 and cover elements according to FIG. 3, which form further parts for forming a closed belt chamber 17, can be arranged on the cutting arm 11. The cutting arm 11 is screwed to the housing 10 via fastening means 25. In a manner, which is also not shown in detail, the housing 10 can form a base body of the abrasive cutting machine 100 or even a housing part of the combustion engine of the abrasive cutting machine 100, for example a part of the crankcase.

A fan chamber 14, in which a fan wheel 15 is accommodated so as to be capable of being driven by the engine of the abrasive cutting machine 100, is embodied in the housing 10. An air flow 16, which serves to tool the internal combustion engine of the abrasive cutting machine 100, for example, is formed by means of the rotary motion of the fan wheel 15.

According to the invention, an air duct 18, through which a part of the air flow 16, which is formed by means of the fan wheel 15, can pass and which leads into the belt chamber 17, so as to apply a sealing air to the belt chamber 17, is introduced into the housing 10, as is illustrated in more detail in FIG. 2 below.

Figure 2:
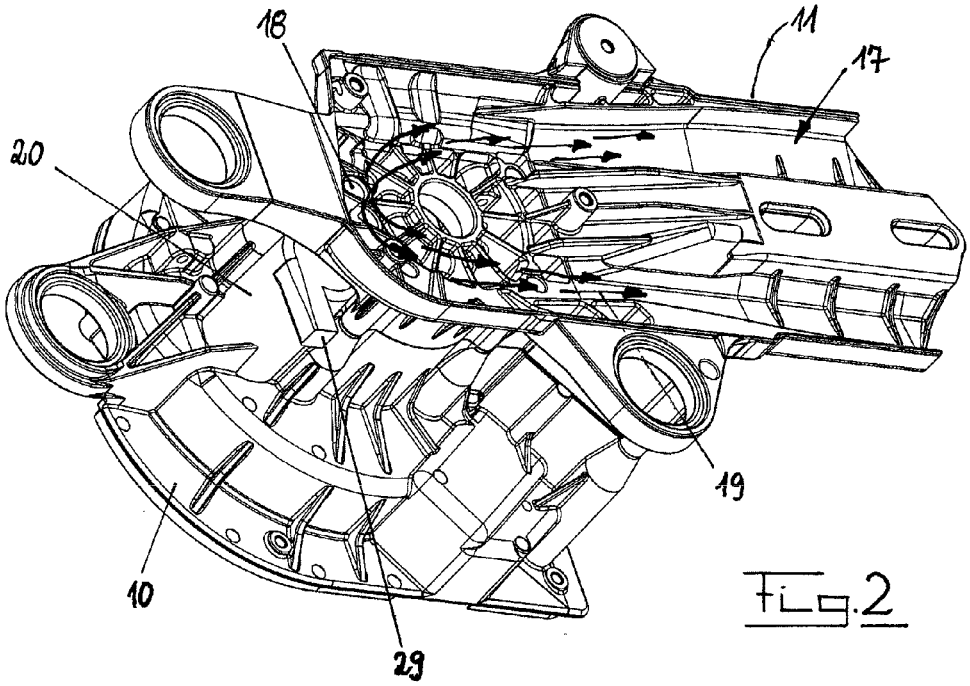
FIG. 2 shows a perspective illustration of the housing and of the cutting arm accommodated on the housing.

FIG. 2 shows a perspective illustration of the housing 10 and of the cutting arm 11 from a viewing direction, which illustrates the mouth of the air duct 18 into the belt chamber 17 of the cutting arm 11. The sealing air flow 19 flows from the air duct 18 into the belt chamber. In the event that the cover elements are arranged on the cutting arm 11, a closed belt chamber 17 is formed, and an overpressure can be formed in the closed belt chamber 17 by means of the sealing air flow 19. The belt, which is not shown in detail, which is accommodated in the belt chamber 17, can thereby be operated free from dust and other impurities, because the overpressure in the belt chamber 17 prevents a permeation of dust and impurities. In particular, the overpressure in the belt space 17 has the effect that the sealing air 19 can escape to the outside through small openings, cracks and gaps, so that the permeation of impurities into the belt chamber 17 is already prevented through this.

A cyclone filter 20 is arranged between the side of the air duct 18 in the housing 10 shown in FIG. 1 and the side of the air duct 18 in the cutting arm 11 shown in FIG. 2. The cyclone filter 20 consequently forms a central part of the air duct 18, because the part of the air flow 16 from the fan chamber 14, which is branched off into the air duct 18, flows through the cyclone filter 20 and guides it to the mouth side of the air duct 18 in the cutting arm 11. The cyclone filter 20 serves to clean the sealing air 19, which is transferred from the fan chamber 14 into the belt chamber 17, and the cyclone filter 20 encompasses an outlet opening 29 for that part of the separated air, which is exposed to dust and impurities. The mouth side of the air duct 18 in the cutting arm 11 is consequently connected to the clean side of the cyclone filter 10. It is shown in FIG. 1 that the air duct 18 is formed through the inlet area of the cyclone filter 20, and the retentive arrangement of the cyclone filter 20 between the housing 10 and the cutting arm 11 is already formed in that the inlet area of the cyclone filter 20 encompasses a collar, which is seated in an accommodation, which is introduced into the housing 10. The outlet opening of the cyclone fan 20 on the clean side is further inserted into an opening in the cutting arm 11, which forms the mouth area of the air duct 18 into the belt chamber 17. The cyclone filter 20 can consequently be accommodated between the housing 10 and the cutting arm 11 in a retentive manner without further fastening means.

In a perspective illustration, FIG. 3 shows a first cover element 21 and a second cover element 22. The first cover element 21 can thereby be attached to the free tool-side end of the cutting arm 11 and the second cover element 22 can be attached to the engine-side end of the cutting arm 11 in a manner, which is not illustrated in detail, so as to form a closed belt chamber 17 on the cutting arm 11. A belt clamping device 26, which encompasses an accommodation for a clamping device 27 as well as an accommodation for a clamping screw 28, is arranged in the first cover element 21. A venting device 23, through which the sealing air 19 can escape in a controlled manner, is furthermore arranged on the end side of the first cover element 21.

In a further perspective view, FIG. 4 shows the first cover element 21 comprising the belt clamping device 26, comprising the accommodation 27 for the clamping device and the accommodation 28 for a clamping screw. The venting device 23 is arranged on the outermost end of the cover element 21, and, because it is arranged on the tool-side end of the cutting arm 11, the sealing air flow 19 can flow through the belt chamber 17 across its entire length. As can be seen in FIG. 2, the air duct 18 is located in the engine-side end area of the belt chamber 17 and the sealing air 19 can finally escape from the venting device 23 after passing through the belt chamber 17 from the engine-side end to the tool-side end. The sealing air 19 furthermore escapes from the belt chamber 17 from all of the openings, cracks and gaps, which are already created by means of the belt clamping device 26 comprising the accommodation 27 for the clamping device and the accommodation 28 for the clamping screw, for example. The venting device 23 is shown in more detail in FIGS. 5 and 6 below.

FIG. 5 shows the detailed view of the cover element 21 in the area of the venting device 23, wherein the venting device 23 comprises a non-return valve 24, which is illustrated in a closed state. The non-return valve 24 assumes this state, for example, when the abrasive cutting machine 100 is not in operation and when sealing air 19 does not reach into the belt chamber 17. It is thus prevented that dust and other impurities can permeate into the belt chamber 17 through the venting device 23.

FIG. 6 shows the venting device 23 comprising a non-return valve 24 in an open state, for example when the abrasive cutting machine 100 was put into operation and when sealing air 19 reaches into the belt chamber 17. The non-return valve 24 can thereby be embodied to have automatic spring action or with a spring, for example, which closes the venting device 23 in the event that an overpressure is not present in the belt chamber 17.

The embodiment of the invention is not limited to the above-specified preferred embodiment. Instead, a number of alternatives is possible, which utilizes the illustrated solution even in the case of embodiments, which are of a generally different type. All of the features and/or advantages, which follow from the claims, the description or the drawings, including structural details or spatial arrangements, can be significant for the invention, both alone and in a variety of combinations.

LIST OF REFERENCE NUMERALS

100 abrasive cutting machine
10 housing
11 cutting arm
12 cutting tool
13 belt
14 fan chamber
15 fan wheel
16 air flow
17 belt chamber
18 air duct
19 sealing air flow, sealing air
20 cyclone filter
21 cover element
22 cover element
23 venting device
24 non-return valve
25 fastening means
26 belt clamping device
27 accommodation for clamping device
28 accommodation for clamping screw
29 outlet opening

The invention claimed is:

1. An abrasive cutting machine, comprising:
an engine;
a cutting tool with a driven axis of rotation;
a cutting arm having the cutting tool provided on a distal end thereof,
a cover connected to the cutting arm,
a housing comprising a first side housing and a second side housing laterally separated in a direction parallel to the driven axis of rotation;
the first side housing comprising an enclosed fan chamber;
a fan wheel provided within the enclosed fan chamber to generate an air flow;
the second side housing comprising a substantially closed belt chamber, the belt chamber being delimited by the cutting arm and cover; and
the cutting arm having a belt pulley provided on a proximal end thereof, the cutting tool being driven via a belt connected to the engine via the belt pulley, an air duct connecting the enclosed fan chamber to the substantially closed belt chamber to provide a path for the air flow generated by the fan wheel to create and maintain an overpressure inside the belt chamber to cool the belt and prevent permeation of dust and other impurities into the belt chamber.

2. The abrasive cutting machine according to claim 1, further comprising a cyclone filter, which serves to clean a sealing air that forms the overpressure inside the belt chamber, which reaches from the fan chamber into the belt chamber.

3. The abrasive cutting machine according to claim 2, wherein the cyclone filter is arranged so as to adjoin an inlet and an outlet of the air duct, wherein the cyclone filter is provided within or on the housing and/or the cyclone filter forms a part of the air duct.

4. The abrasive cutting machine according to claim 1, wherein a flow of the sealing air flow is generated by a clean side of the cyclone filter.

5. The abrasive cutting machine according to claim 1, wherein the air flow generated by the fan wheel at least partially-forms a cooling air for the engine of the abrasive cutting machine.

6. The abrasive cutting machine according to claim 1, further comprising a venting device provided in one of the cutting arm and the cover, wherein the vent device allows the sealing air to escape from the belt chamber.

7. The abrasive cutting machine according to claim 6, wherein the venting device includes a non-return valve, through which the sealing air escapes from the belt chamber, wherein the venting device prevents a permeation of contaminated air.

8. The abrasive cutting machine according to claim 6, wherein the air duct leads into the belt chamber on an engine-side end and/or a housing-side end of the cutting arm and wherein the venting device is arranged on a tool-side end of the cutting arm.

9. The abrasive cutting machine according to claim 1, wherein an inlet of the air duct is adjacent the fan chamber and an outlet of the air duct is adjacent the belt chamber.

10. The abrasive cutting machine according to claim 1, wherein the fan chamber and belt chamber are provided at opposite ends of the air duct such that the fan chamber and belt chamber are spaced apart from each other in a rotational axis direction of the fan wheel.

11. The abrasive cutting machine according to claim 1, wherein the fan chamber separately encloses the fan wheel from the belt provided in the belt chamber.

* * * * *